US006640401B2

(12) United States Patent
Chen et al.

(10) Patent No.: US 6,640,401 B2
(45) Date of Patent: Nov. 4, 2003

(54) ENVIRONMENT PROTECTION COFFIN

(76) Inventors: Chung-Huang Chen, No. 293, Sec. 4, Chang-Hsin Rd., Ho-Mei Town, Changhua (TW); Yuan-Chuan Cheng, No. 5, Lane 254, Sec. 1, Yan-Hae Rd., Wen-Tzy Village, Hsien-Hsi Hsiang, Chang Hua Hsien (TW)

( * ) Notice: Subject to any disclaimer, the term of this patent is extended or adjusted under 35 U.S.C. 154(b) by 0 days.

(21) Appl. No.: 10/262,199

(22) Filed: Sep. 30, 2002

(65) Prior Publication Data

US 2003/0093886 A1 May 22, 2003

(51) Int. Cl.[7] ..... A61G 17/00
(52) U.S. Cl. ..... 27/4; 229/199
(58) Field of Search ..... 27/4, 19; 220/6, 220/651, DIG. 30, 653; 229/199, 935, 937, 939

(56) References Cited

U.S. PATENT DOCUMENTS

| | | | | |
|---|---|---|---|---|
| 4,209,880 A | * | 7/1980 | Lidholm | 27/2 |
| 5,307,545 A | * | 5/1994 | Stoltz | 27/4 |
| 5,353,484 A | * | 10/1994 | Woedl et al. | 27/4 |
| 5,815,898 A | * | 10/1998 | Jenkins | 27/4 |
| 6,105,220 A | * | 8/2000 | Belanger | 27/4 |
| 6,145,175 A | * | 11/2000 | Enneking et al. | 27/4 |

* cited by examiner

*Primary Examiner*—William L. Miller
(74) *Attorney, Agent, or Firm*—Pro-Techtor International Services

(57) ABSTRACT

An environment protection coffin is constructed to include a coffin body made by folding up a patterned sheet material into shape, which patterned sheet material is formed of an outer shell, an inner shell, and at least one intermediate lining shell sandwiched in between the outer shell and the inner shell.

12 Claims, 10 Drawing Sheets

ENVIRONMENT PROTECTION COFFIN

CROSS REFERENCE TO RELATED APPLICATION

This application is related to Taiwan Utility Model Application Serial No. 90219958 filed on Nov. 16, 2001.

BACKGROUND OF THE INVENTION

1. Field of the Invention

The present invention relates to a coffin and, more particularly, to an environment protection coffin, which is made by folding up a patterned sheet member of environment protective material or recycled paper into shape.

2. Description of the Related Art

Conventional coffins are commonly made of stone, metal (copper), or wooden material. A stone or metal coffin is heavy and expensive, and provided for burying in a burial ground. Because of high cost, stone or metal coffins are not popularly accepted. Wooden coffins are made of wooden material. Due to environment protection's sake, it is more and more difficult to cut trees in order to obtain lumber. Nowadays, cremation has been widely accepted when treating a dead body. However, because regular coffins for cremation are commonly made of wooden material, they consume much fuel during cremation. When burned out with the dead body, many impurity materials will be produced.

SUMMARY OF THE INVENTION

The present invention has been accomplished under the circumstances in view. It is one object of the present invention to provide an environment protection coffin, which is easy and inexpensive to manufacture. It is another object of the present invention to provide an environment protection coffin, which eliminates the use of lumber. It is still another object of the present invention to provide an environment protection coffin, which is highly inflammable so that less fuel is required when burning the dead body. It is still another object of the present invention to provide an environment protection coffin, which can fully be burned out without producing impurity material when burning with the dead body. It is still another object of the present invention to provide an environment protection coffin, which greatly shortens the cremation. It is still another object of the present invention to provide an environment protection coffin, which does not cause any secondary public pollution when burned out.

According to one aspect of the present invention, the environment protection coffin comprises a coffin body made by folding up a patterned sheet material into shape. According to another aspect of the present invention, the patterned sheet material is cut subject to a predetermined pattern, and comprised of an outer shell, an inner shell, and at least one intermediate lining shell sandwiched in between the outer shell and the inner shell. The outer shell and the inner shell and the at least one intermediate lining shell each comprise a rectangular base panel, two elongated side panels at two opposite long sides of the base panel, two end flaps at two opposite short sides of the base panel, and two pairs of end lugs respectively longitudinally extended from two distal ends of each of the elongated side panels, two longitudinal folding lines respectively longitudinally extended between the two opposite long sides of the base panel and the elongated side panels, and two transverse folding lines respectively transversely extended between the two opposite short sides of the base panel and the end flaps across the connection areas between the ends of the elongated side panels and the end lugs. According to still another aspect of the present invention, each intermediate lining sheet has a plurality of transverse recesses arranged in parallel in the respective base panel and a plurality of reinforcing plates bonded to the transverse recesses.

The environment protection coffin can be made for a dead human body. It can also be made for a dead animal body.

DETAILED DESCRIPTION OF THE PREFERRED EMBODIMENT

Figure 1:
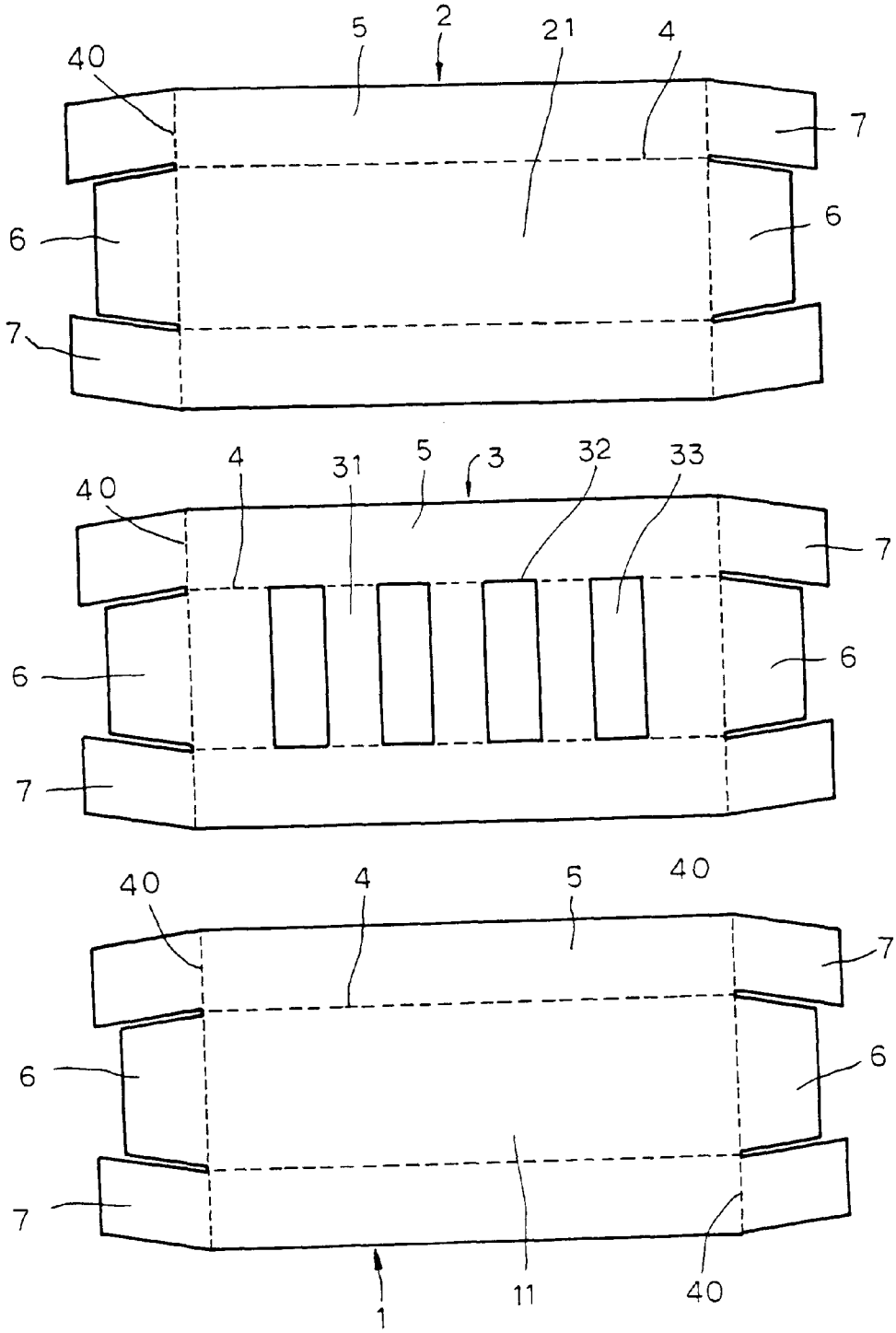
FIG. 1 is an exploded view of a coffin body made according to the first embodiment of the present invention.
Figure 2:
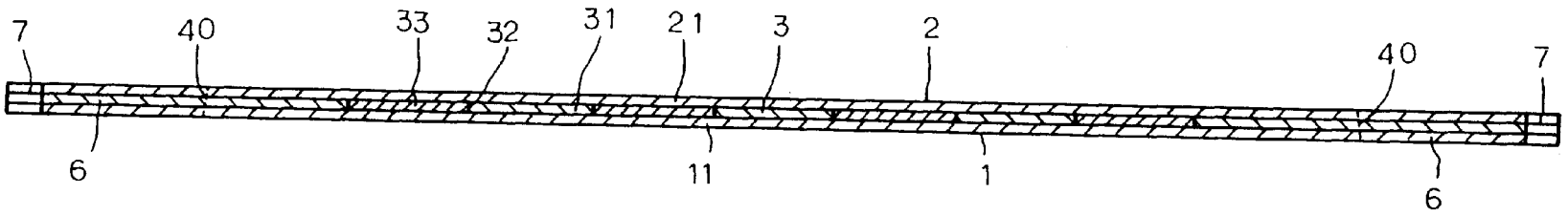
FIG. 2 is a sectional view of the patterned sheet material for the coffin body according to the first embodiment of the present invention.

Referring to FIGS. from 1 through 10, an environment protection coffin in accordance with the present invention is generally comprised of an outer shell 1, an inner shell 2, and at least one lining shell 3.

Figure 3:
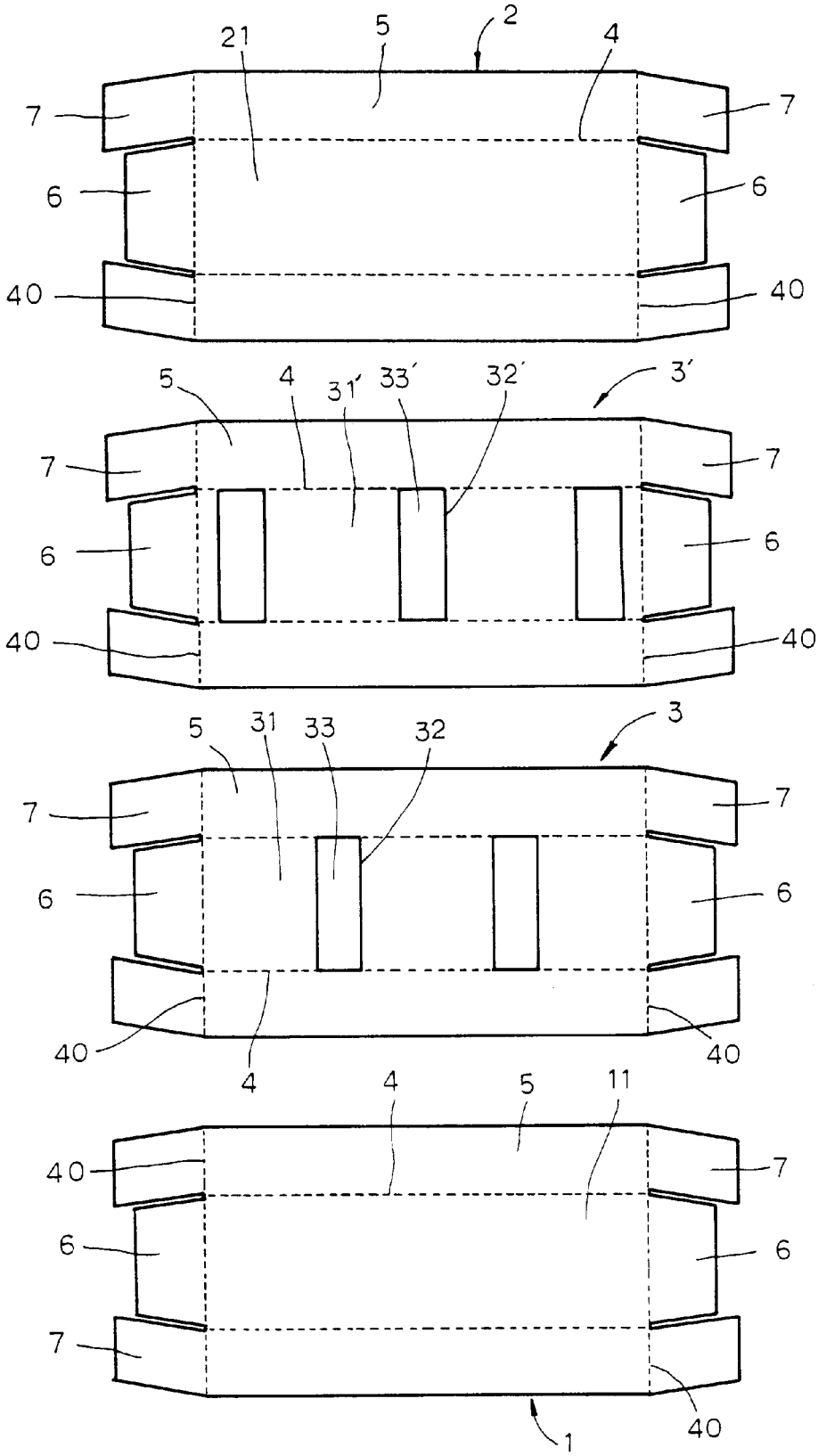
FIG. 3 is an exploded view of a coffin body made according to the second embodiment of the present invention.

According to the first embodiment of the present invention as shown in FIGS. 1 and 3, the environment protection coffin is comprised of an outer shell 1, an inner shell 2, and one intermediate lining shell 3.

The outer shell 1 is made of a sheet member cut subject to a predetermined pattern, comprising a rectangular base panel 11, two elongated side panels 5 at two opposite long sides of the base panel 11, two end flaps 6 at two opposite short sides of the base panel 11, and two pairs of end lugs 7 respectively longitudinally extended from the two distal ends of each of the elongated side panels 5, two longitudinal folding lines 4 respectively longitudinally extended between the two opposite long sides of the base panel 11 and the elongated side panels 5, and two transverse folding lines 40 respectively transversely extended between the two opposite short sides of the base panel 11 and the end flaps 6 across the connection areas between the ends of the elongated side panels 5 and the end lugs 7.

The outer shell 2 is identical to the outer shell 1, therefore like reference numbers are used to indicate like members. However, reference number 21 is used to indicate the rectangular base panel of the outer shell 2 because the rectangular base panel 21 of the outer shell 2 serves as a bearing panel.

The intermediate lining shell 3 is similar to the inner shell 1 and the outer shell 2 with the exception of the design of the rectangular base panel. The rectangular base panel, referenced by 31, of the intermediate lining shell 3 has a plurality of transverse recesses 32 arranged in parallel, and a plurality of reinforcing plates 33 bonded to the transverse recesses 32.

Figure 8:
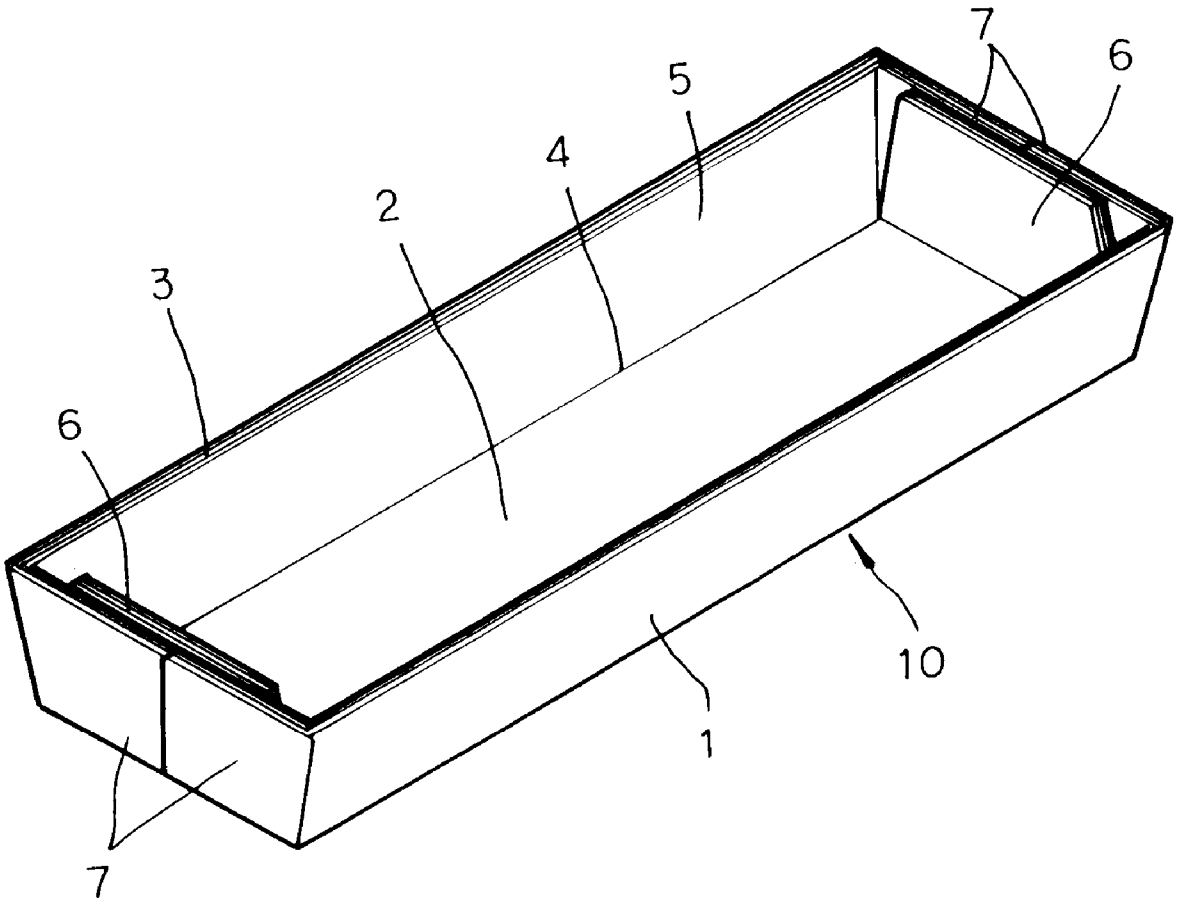
FIG. 8 is an elevational view of a coffin body made according to the first embodiment of the present invention.

Referring to FIGS. 8, the outer shell 1, the inner shell 2, and the intermediate lining shell 3 are adhered to one another in a stack with the intermediate lining shell 3 sandwiched in between the outer shell 1 and the inner shell 2 to form a patterned sheet material, and then side panels 5 of the patterned sheet material are respectively folded up along the longitudinal folding lines 4 from horizontal position to vertical position, and then the end flaps 6 of the patterned sheet material are respectively folded up along the transverse folding lines 40 from horizontal position to vertical position, and then the end lugs 7 of the patterned sheet material are respectively folded up along the transverse folding lines 40 and respectively attached to the erected end flaps 6, forming a coffin body 10.

Figure 4:
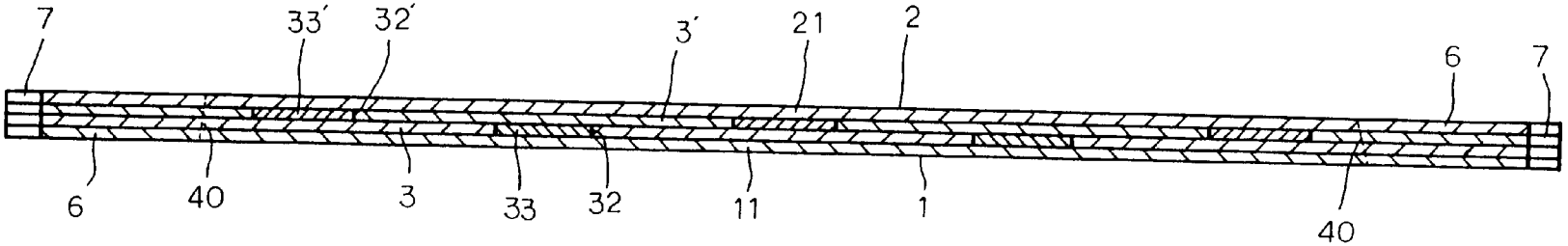
FIG. 4 is a sectional view of the patterned sheet material for the coffin body according to the second embodiment of the present invention.

FIGS. 3 and 4 show an environment protection coffin according to the second embodiment of the present invention. This embodiment includes two intermediate lining shells 3 and 3' sandwiched in between the outer shell 1 and the inner shell 2. The intermediate lining shells 3 and 3' each have a plurality of a plurality of transverse recesses 32 or 32' arranged in parallel in the respective rectangular base panel 31 or 31', and a plurality of reinforcing plates 33 or 33' bonded to the transverse recesses 32 or 32'. However, the reinforcing plates 33 and 33' of the intermediate lining shells 3 and 3' are preferably arranged in a staggered manner and not respectively vertically aligned. When the outer shell 1 and the inner shell 2 are bonded together with the intermediate lining shells 3 and 3' sandwiched in therebetween to form a patterned sheet material, the patterned sheet material is then folded up to form a coffin body in the same manner as the aforesaid first embodiment of the present invention.

Figure 5:
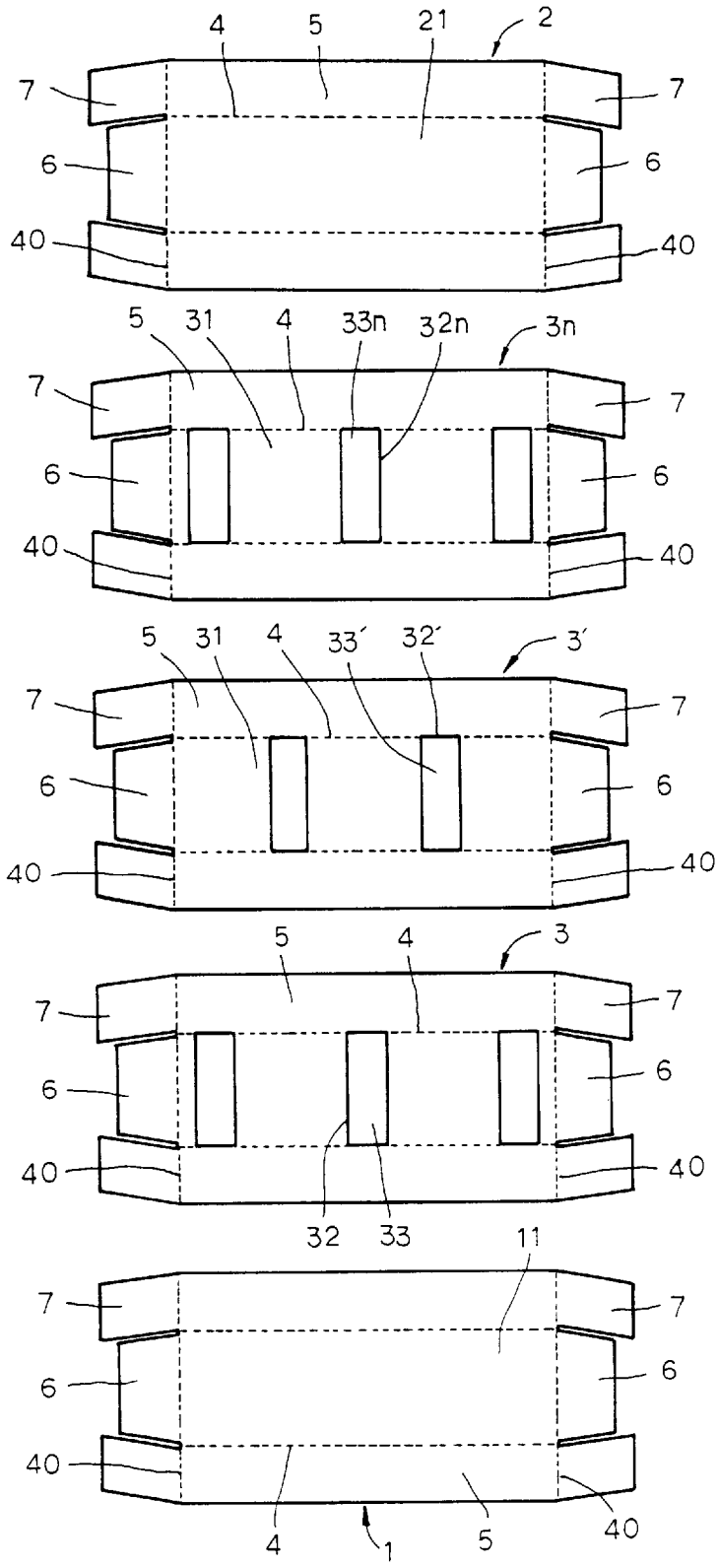
FIG. 5 is an exploded view of a coffin body made according to the third embodiment of the present invention.
Figure 6:
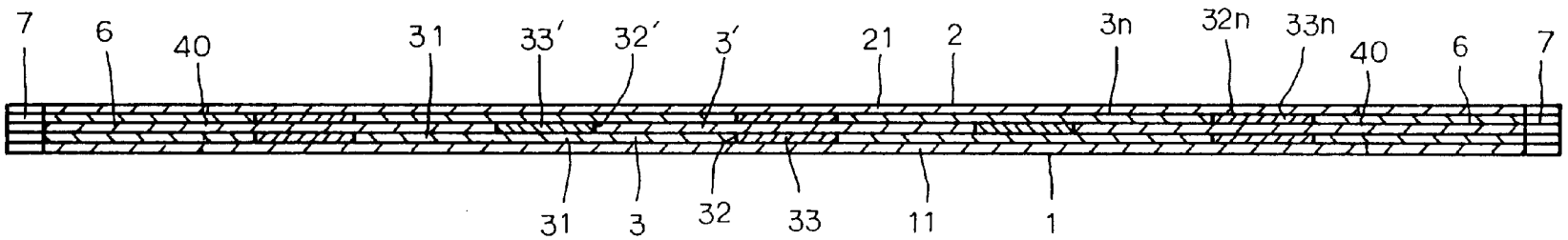
FIG. 6 is a sectional view of the patterned sheet material for the coffin body according to the third embodiment of the present invention.

FIGS. 5 and 6 show an environment protection coffin according to the third embodiment of the present invention. This embodiment includes at least three intermediate lining shells 3, 3', and 3$^n$ arranged in a stack and sandwiched in between the outer shell 1 and the inner shell 2. The intermediate lining shells 3, 3', and 3$^n$ each have a plurality of a plurality of transverse recesses 32, 32', or 32$^n$ arranged in parallel in the respective rectangular base panel 31, 31', or 31$^n$, and a plurality of reinforcing plates 33, 33', or 33$^n$ bonded to the transverse recesses 32, 32', or 32$^n$. However, the reinforcing plates 33, 33', or 33$^n$ of the intermediate lining shells 3, 3', and 3$^n$ are preferably arranged in a staggered manner and not respectively vertically aligned. When the outer shell 1 and the inner shell 2 are bonded together with the intermediate lining shells 3, 3', and 3$^n$ sandwiched in therebetween to form a patterned sheet material, the patterned sheet material is then folded up to form a coffin body in the same manner as the aforesaid first embodiment of the present invention.

The aforesaid outer shell 1, inner shell 2, and intermediate lining shells 3, 3', and 3$^n$ are preferably made of corrugated cardboards, recycled paper material, or any of a variety of environment protection materials. The reinforcing plates 33, 33', and 33$^n$ increase the weight of the coffin and reinforce the structural strength of the coffin. They can be made of plywood, cardboard, wooden slats, or plastic material that is decomposable or does not produce toxic material when burned.

Figure 7:
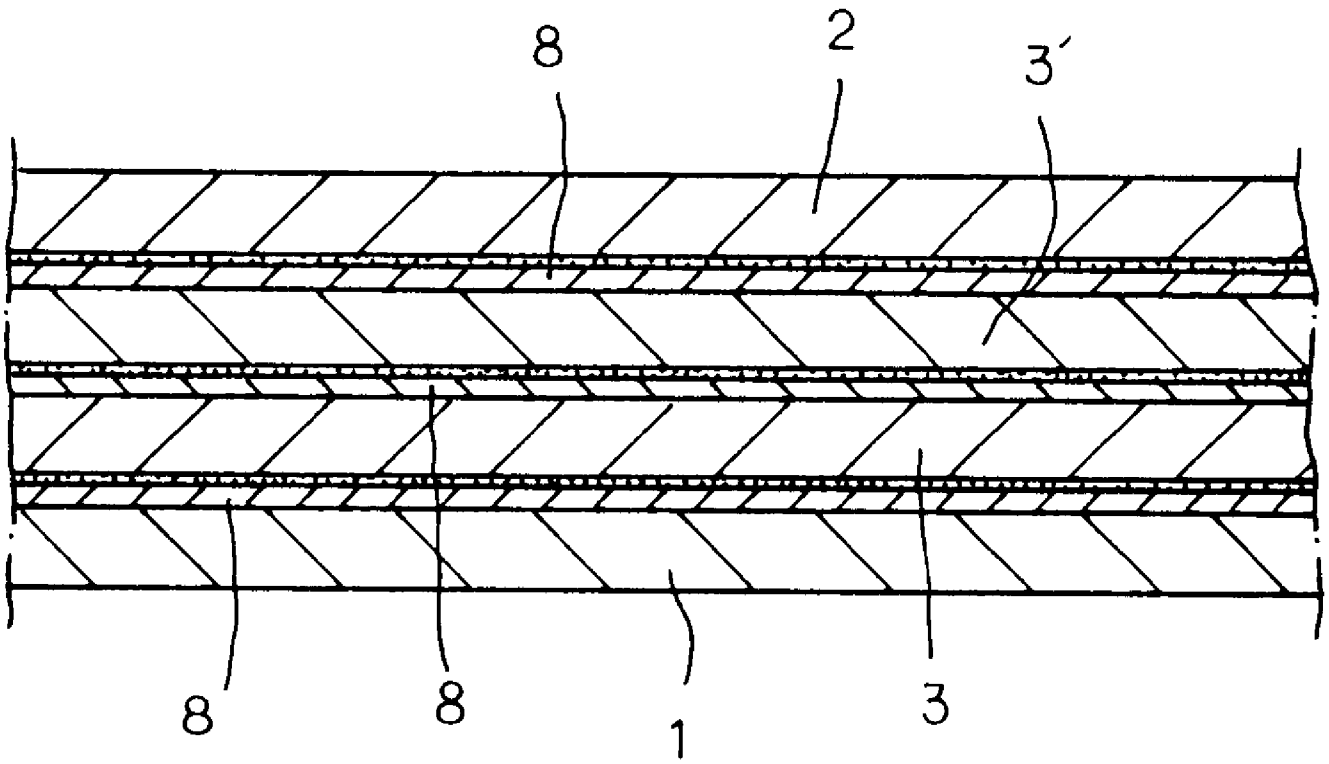
FIG. 7 is a sectional view showing the outer shell, the inner shell, and the intermediate lining shells respectively bonded with a thin layer of sheet material according to the present invention.

Referring to FIG. 7, the aforesaid outer shell 1, inner shell 2, and intermediate lining shells 3, 3', and 3$^n$ may be respectively bonded with a thin layer of sheet material 8 to improve the toughness of the coffin and to protect the coffin against water and moisture. The thin layer of sheet material 8 can be obtained from woven fabric, non-woven fabric, waterproof paper, or plastic sheet material.

Figure 9:
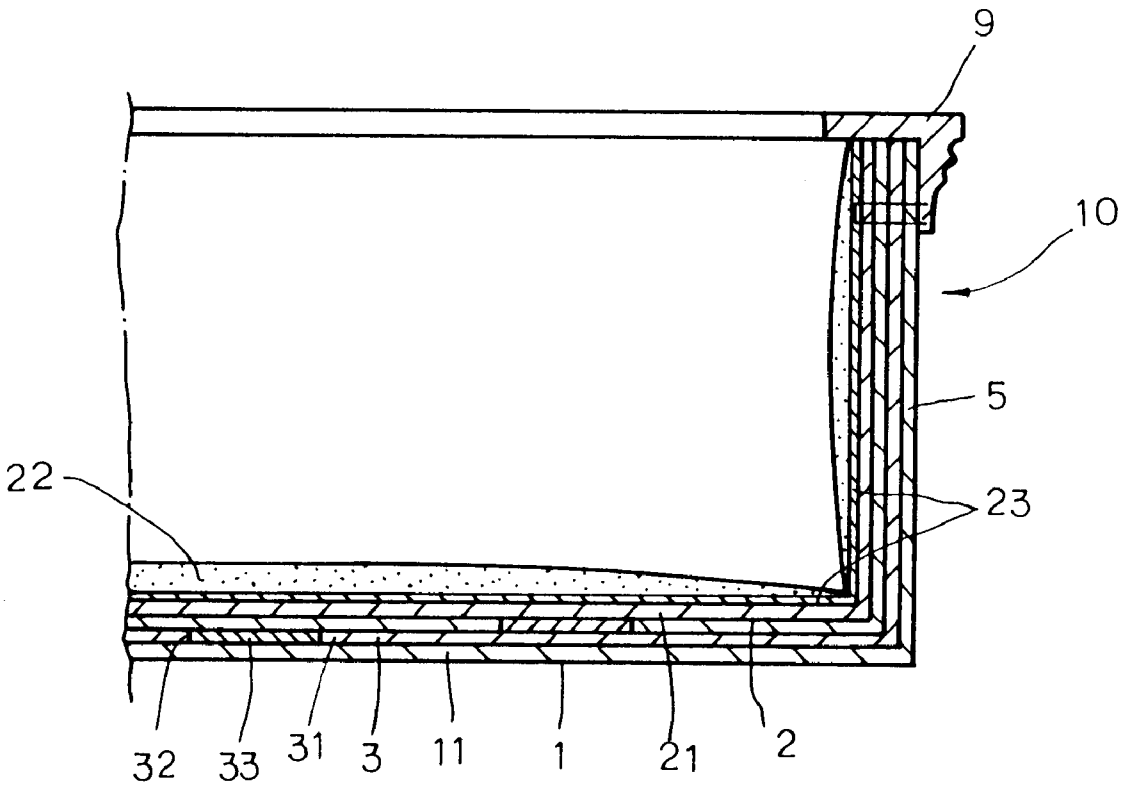
FIG. 9 is a sectional view showing the outer surface of the inner shell covered with a layer of waterproof material and a layer of soft overlay over the layer of waterproof material, and a top frame fastened to the coffin body according to the present invention.
Figure 10:
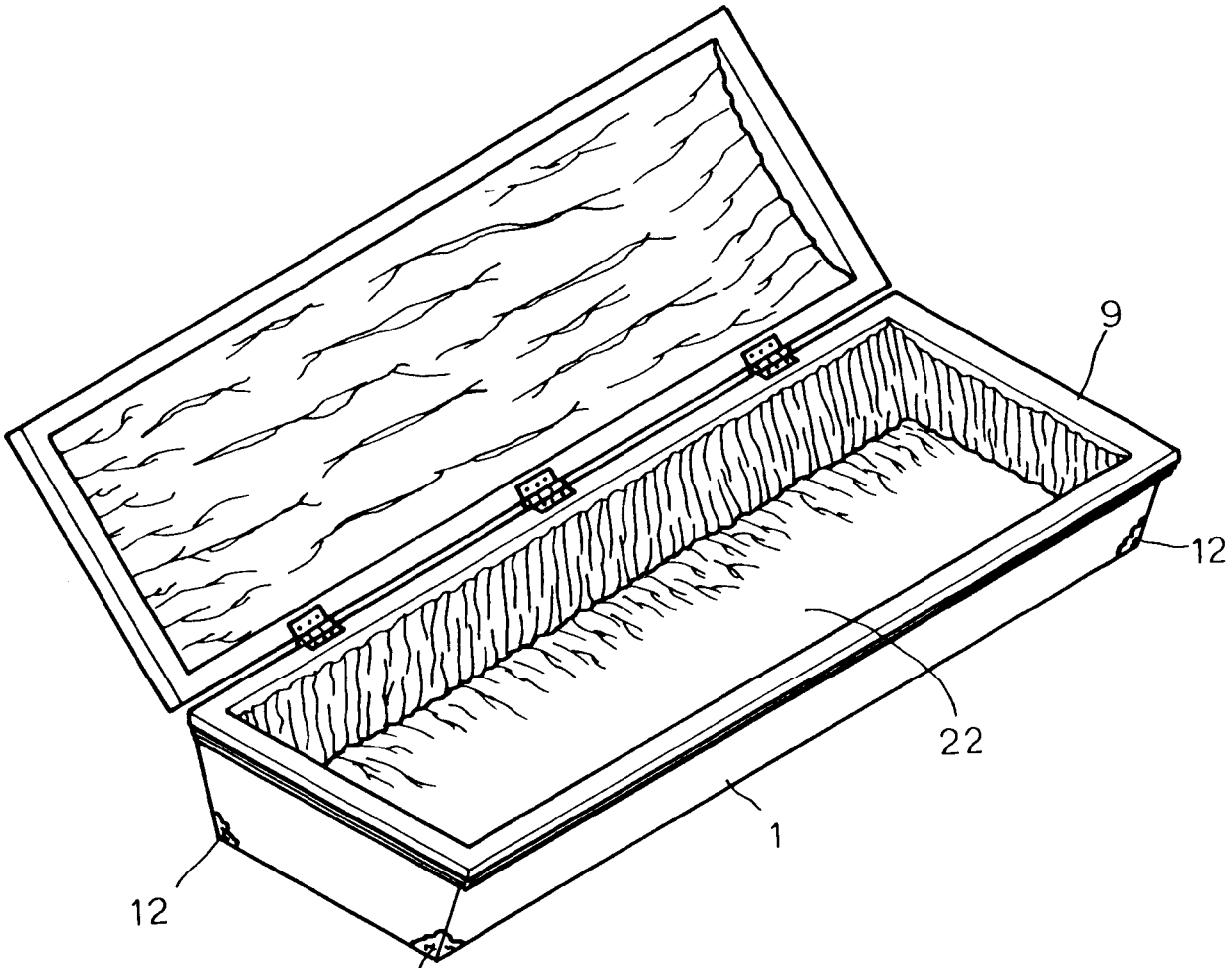
FIG. 10 is an elevational view of an environment protection coffin constructed according to the present invention.

Referring to FIGS. 9 and 10, the outer surface of the inner shell 2 is preferably covered with a layer of waterproof material 23 and then a layer of soft overlay 22 over the layer of waterproof material 23. The layer of soft overlay 22 can be made of velvet or the like that makes the inside of the coffin beautiful. Ornamental corner fittings 12 may be fastened to the corners of the outside wall of the coffin body 10. Further, a top frame 9 is fixedly provided at the top of the coffin body 10 around its top opening to reinforce the structural strength of the coffin body 10 for receiving a lid panel (coffin cover). The top frame 9 may be adhered to the coffin body 10, or fixedly fastened to the coffin body 10 by fastening elements such as nails, screws, etc.

As indicated above, the present invention provides an environment protection coffin, which is cheap, environment protective, pollution free, and lightweight. An environment protection coffin having the net weight of about 15 kgs is sufficient to carry the load of about 200 kgs.

A prototype of environment protection coffin has been constructed with the features of FIGS. 1~10. The environment protection functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An environment protection coffin comprising a coffin body made by folding up a patterned sheet material into shape, said patterned sheet material being cut subject to a predetermined pattern, wherein said patterned sheet material comprises an outer shell, an inner shell, and at least one intermediate lining shell sandwiched in between said outer shell and said inner shell, said outer shell and said inner shell and said at least one intermediate lining shell each comprising a rectangular base panel, two elongated side panels at two opposite long sides of said base panel, two end flaps at two opposite short sides of said base panel, and two pairs of end lugs respectively longitudinally extended from two distal ends of each of said elongated side panels, two longitudinal folding lines respectively longitudinally extended between the two opposite long sides of said base panel and said elongated side panels, and two transverse folding lines respectively transversely extended between the two opposite short sides of said base panel and said end flaps across the connection areas between the ends of said elongated side panels and said end lugs, said at least one intermediate lining sheet each having a plurality of transverse recesses arranged in parallel in the respective base panel and a plurality of reinforcing plates bonded to said transverse recesses.

2. The environment protection coffin as claimed in claim 1, wherein said outer shell, said inner shell, and said at least one intermediate lining shell are respectively made of one of the material group including corrugated cardboard and recycled paper material.

3. The environment protection coffin as claimed in claim 1, wherein said reinforcing plates are respectively made of one of the material group including plywood, cardboard, wooden slats, and plastic material that is decomposable or does not produce toxic material when burned.

4. The environment protection coffin as claimed in claim 1, wherein said outer shell, said inner shell, and said at least one intermediate lining shell are respectively bonded with a layer of sheet material selective from the material group including woven fabric, non-woven fabric, waterproof paper, and plastic sheet material.

5. The environment protection coffin as claimed in claim 1, wherein said inner shell has an outside wall covered with a layer of waterproof material.

6. The environment protection coffin as claimed in claim 1, wherein said inner shell has an outside wall covered with a layer of soft ornamental material.

7. The environment protection coffin as claimed in claim 1, wherein said outer shell has an outside wall covered with ornamental means.

8. The environment protection coffin as claimed in claim 1, wherein said at least one intermediate lining sheet include at least two intermediate lining sheets bonded together, and the reinforcing plates of said at least one two intermediate lining sheets are arranged in a staggered manner.

9. The environment protection coffin as claimed in claim 1, wherein said coffin body has a top side fixedly mounted with a top frame around a top opening thereof.

10. The environment protection coffin as claimed in claim 9, wherein said top frame is adhered to the top side of said coffin body.

11. The environment protection coffin as claimed in claim 9, wherein said top frame is nailed to the top side of said coffin body.

12. The environment protection coffin as claimed in claim 9, wherein said top frame is fixedly fastened to the top side of said coffin body by screws.

* * * * *